US012637779B1

(12) United States Patent
Shaddad

(10) Patent No.: US 12,637,779 B1
(45) Date of Patent: May 26, 2026

(54) METHOD FOR GENERATING HYDROGEN PEROXIDE WITH NANOPARTICLE ELECTRODE

(71) Applicant: PRINCE SATTAM BIN ABDULAZIZ UNIVERSITY, Al-Kharj (SA)

(72) Inventor: Maged Naji Yahya Shaddad, Al-Kharj (SA)

(73) Assignee: PRINCE SATTAM BIN ABDULAZIZ UNIVERSITY, Al-Kharj (SA)

( * ) Notice: Subject to any disclaimer, the term of this patent is extended or adjusted under 35 U.S.C. 154(b) by 0 days.

(21) Appl. No.: 19/387,547

(22) Filed: Nov. 12, 2025

Related U.S. Application Data

(62) Division of application No. 19/308,041, filed on Aug. 22, 2025.

(51) Int. Cl.

| | |
|---|---|
| ***C25B 11/077*** | (2021.01) |
| ***C25B 1/30*** | (2006.01) |
| ***C25B 11/037*** | (2021.01) |
| ***C25B 11/067*** | (2021.01) |

(52) U.S. Cl.
CPC ..... *C25B 11/077* (2021.01); *C25B 1/30* (2013.01); *C25B 11/037* (2021.01); *C25B 11/067* (2021.01)

(58) Field of Classification Search
CPC ..... C25B 11/077; C25B 1/30; C25B 11/037; C25B 11/067
See application file for complete search history.

(56) References Cited

U.S. PATENT DOCUMENTS

| | | | | |
|---|---|---|---|---|
| 8,492,303 | B2 * | 7/2013 | Bulan | C25B 11/093 502/313 |
| 2021/0220803 | A1 * | 7/2021 | Li | C25B 11/052 |
| 2023/0141805 | A1 * | 5/2023 | Zhang | G01N 27/3277 205/782 |

FOREIGN PATENT DOCUMENTS

| | | | |
|---|---|---|---|
| CN | 107293698 | A | 10/2017 |
| CN | 109546130 | A | 3/2019 |
| CN | 116947169 | A | 10/2023 |
| SA | 16128 | B1 | 5/2024 |
| SG | 182867 | A1 | 8/2012 |

OTHER PUBLICATIONS

"Carbon-Doped Titanium Dioxide Nanoparticles: A Facile Synthesis, Characterization and Their Photocatalytic Activity" by Negi et al., Mater. Today Proc. 28, pp. 710-712 (2020).*

(Continued)

*Primary Examiner* — Bryan D. Ripa
(74) *Attorney, Agent, or Firm* — Oblon, McClelland, Maier & Neustadt, L.L.P.

(57) ABSTRACT

An electrode which includes nanoparticles of a carbon-doped tin oxide of formula C—$SnO_{2-x}$ where x=is from 0.001 to 0.1, having surface oxygen vacancies. The electrode includes a fluorine-doped tin oxide substrate. A film of the nanoparticles is present on at least one surface of the fluorine-doped tin oxide substrate. The surface oxygen vacancies correspond to an O 1*s* peak shift of 0.5-2 eV in the X-ray photoelectron spectroscopy (XPS) for C—$SnO_{2-x}$ compared to C—$SnO_2$ without surface oxygen vacancies.

8 Claims, 6 Drawing Sheets

(56) References Cited

OTHER PUBLICATIONS

"Carbon-Doped Tin Oxide Films Fabricated by Pulse DC Magnetron Sputtering Using CO2 as Reactive Gas and Their Application as Anodes in Lithium-Ion Batteries" by Ma et al., Solid State Ion. 368, 115683 (2021).*

"Improved Photocatalytic Activity of Sr Doped SnO2 Nanoparticles: A Role of Oxygen Vacancy" by Ahmed et al., Appl. Surf. Sci. 463, pp. 976-985 (2019).*

"Intrinsic Carbon-Doping Induced Synthesis of Oxygen Vacancies—Mediated TiO2 Nanocrystals: Enhanced Photocatalytic NO Removal Performance and Mechanism" by Gu et al., J. Catal. 393, pp. 179-189 (2021).*

"Low Temperature Preparation of Oxygen-Deficient Tin Dioxide Nanocrystals and a Role of Oxygen Vacancy in Photocatalytic Activity Improvement" by Anuchai et al., J. Colloid Interface Sci. 512, pp. 105-114 (2018).*

N. Lavanya, et al., "Fabrication of hydrogen peroxide biosensor based on Ni doped SnO2 nanoparticles", Biosensors and Bioelectronics, vol. 36, Issue 1, Jun.-Jul. 2012, pp. 41-47, 8 pages.

* cited by examiner

METHOD FOR GENERATING HYDROGEN PEROXIDE WITH NANOPARTICLE ELECTRODE

CROSS-REFERENCE TO RELATED APPLICATIONS

The present application is a Divisional of U.S. application Ser. No. 19/308,041, pending, having a filing date of Aug. 22, 2025.

BACKGROUND

Technical Field

The present disclosure relates to an electrode, more particularly, the present disclosure pertains to a method of preparation thereof and its use for the electrochemical production and detection of hydrogen peroxide.

Description of Related Art

The 'background' description provided herein is for the purpose of generally presenting the context of the disclosure. The work of the presently named inventors, to the extent it is described in this background section, as well as aspects of the description which may not otherwise qualify as prior art at the time of filing, are neither expressly nor impliedly admitted as prior art against the present invention.

Hydrogen peroxide is a versatile oxidant widely employed across industries such as chemical synthesis, healthcare, water treatment, and renewable energy due to its clean decomposition and strong oxidizing ability. The predominant production method-using the anthraquinone process-utilizes hazardous solvents, demands high energy, and poses safety concerns during transportation and storage.

Electrochemical production of hydrogen peroxide via the two-electron oxygen reduction reaction (ORR) provides a promising alternative, enabling on-site generation at lower potentials while minimizing explosion hazards. Achieving high selectivity toward hydrogen peroxide over water depends on tuning catalyst properties to favor the two-electron pathway by enhancing intermediate adsorption and preserving the oxygen-oxygen bond. Tin oxide is a promising, inexpensive electrocatalyst for ORR, yet its current performance falls short.

Accordingly, an object of the present disclosure is directed to an electrocatalyst configured to selectively promote the two-electron oxygen reduction reaction for efficient in situ hydrogen peroxide generation, thereby overcoming the limitations of the prior art.

SUMMARY

In an exemplary embodiment, an electrode is described. The electrode includes nanoparticles of a carbon-doped tin oxide of formula C—$SnO_{2-x}$ where x=is from 0.001 to 0.1, having surface oxygen vacancies. The electrode includes a fluorine-doped tin oxide substrate. A film of the nanoparticles is present on at least one surface of the fluorine-doped tin oxide substrate. The surface oxygen vacancies correspond to a O 1s peak shift of 0.5-2 eV in the X-ray photoelectron spectroscopy (XPS) for C—$SnO_{2-x}$ compared to C—$SnO_2$ without surface oxygen vacancies.

In some embodiments, the nanoparticles have an average diameter of 1-5 nm.

In some embodiments, the nanoparticles have a hydrogen peroxide detection sensitivity of 2-5 $\mu A\ \mu M^{-1}\ cm^{-2}$.

In some embodiments, the electrode is crystalline.

In some embodiments, a method of generating hydrogen peroxide is described. The method includes applying an electrical potential to an electrolytic cell including the electrode an anode and an electrolytic solution, to form the hydrogen peroxide.

In some embodiments, the electrolytic solution includes water, a base and dissolved oxygen.

In some embodiments, the base is KOH.

In some embodiments, the concentration of base is 1 M.

In another exemplary embodiment, a method of detecting hydrogen peroxide at a concentration of 1 μM to 20 μM in an alkaline solution is described. The method includes immersing the electrode into an electrolytic cell containing the alkaline solution. The method includes applying an electrical potential to the electrolytic cell and recording a peak current. The method includes determining a concentration of the $H_2O_2$ in the alkaline solution.

In some embodiments, the alkaline solution is an aqueous solution of KOH.

In some embodiments, the concentration of KOH is 1 M.

In some embodiments, the peak current density is directly proportional to the concentration of $H_2O_2$ in the alkaline solution.

In some embodiments, the electrical potential is 0.4-0.9 V vs. SCE.

In yet another exemplary embodiment, a method of making the electrode is described. The method includes autoclaving a mixture including a tin salt, a sugar and water to form a reaction product. The method includes vacuum heat treating the reaction product to form the nanoparticles. The method includes coating a surface of a fluorine-doped tin oxide substrate with the nanoparticles.

In some embodiments, the tin salt is tin chloride.

In some embodiments, the concentration of the tin salt is 10-30 mM.

In some embodiments, the sugar is sucrose.

In some embodiments, the concentration of the sugar is 0-4 M.

In some embodiments, the autoclaving is at a temperature of 80-100° C.

In some embodiments, the vacuum heat treating is at a temperature of 300-400° C.

The foregoing general description of the illustrative embodiments and the following detailed description thereof are merely exemplary aspects of the teachings of this disclosure, and are not restrictive.

BRIEF DESCRIPTION OF THE DRAWINGS

A more complete appreciation of this disclosure and many of the attendant advantages thereof will be readily obtained as the same becomes better understood by reference to the following detailed description when considered in connection with the accompanying drawings, wherein.

DETAILED DESCRIPTION

Figure 1A:
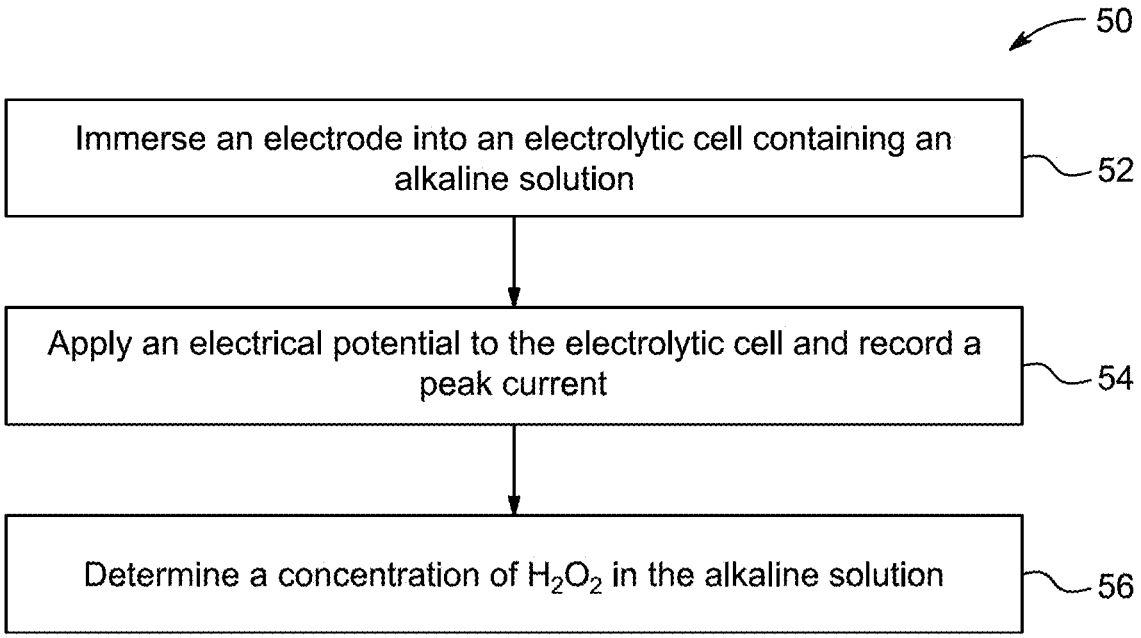
FIG. 1A is a schematic diagram of a flow chart of a method of detecting hydrogen peroxide at a concentration of 1 μM to 20 μM in an alkaline solution, according to certain embodiments.

In the drawings, reference numerals designate identical or corresponding parts throughout the several views. Further, as used herein, the words 'a', 'an' and the like generally carry a meaning of 'one or more', unless stated otherwise.

Furthermore, the terms 'approximately,' 'approximate', 'about' and similar terms generally refer to ranges that include the identified value within a margin of 20%, 10%, or preferably 5%, and any values therebetween.

As used herein, the term 'electrode' refers to a solid conductor-generally metal, carbon, or coated material-immersed in an electrochemical system that facilitates electron transfer between the external circuit and the electrolyte.

As used herein, the term 'surface oxygen vacancies' refers to deliberately created missing oxygen atoms at or near the surface of an oxide-based material (such as $SnO_2$), which alter its electronic structure and catalytic behavior by providing additional active sites or modifying adsorption properties.

As used herein, the term 'hydrogen peroxide detection sensitivity' refers to the ability of an analytical or electrochemical system to reliably detect low concentrations of $H_2O_2$, typically quantified by the minimum detectable concentration (limit of detection) and the rate of signal change per unit concentration (sensitivity).

As used herein, the term 'crystalline' refers to a solid material characterized by a long-range ordered atomic or molecular structure, with repeating lattice patterns that can be confirmed by diffraction techniques such as X-ray diffraction (XRD).

As used herein, the term 'electrolytic cell' refers to an apparatus including at least two electrodes (anode and cathode) immersed in an electrolyte solution and connected to an external power source, enabling controlled redox reactions via applied electrical current.

As used herein, the term 'anode' refers to the electrode in an electrochemical cell where oxidation reactions occur-that is, where electrons are released from species in the electrolyte into the external circuit.

As used herein, the term 'electrolytic solution' refers to the liquid medium (electrolyte) in which electrochemical reactions take place within the cell, generally containing ions that conduct electricity and may include pH buffers or reactants essential for the intended redox process.

Aspects of the present disclosure are directed toward an electrochemical electrode for the production and detection of hydrogen peroxide utilising nanoparticles of carbon doped tin oxide thin films with surface oxygen vacancies. Such films are fabricated via the hydrothermal method from an aqueous solution of tin salts with different concentration of sucrose, without the use of templates, membranes, or surfactants, by heating in a vacuum at varying temperatures on fluorine-doped tin oxide substrates thin films.

In the present disclosure an electrode is described. The electrode includes nanoparticles of a carbon-doped tin oxide of formula C—$SnO_{2-x}$ where x=is from 0.001 to 0.1, having surface oxygen vacancies. The surface oxygen vacancies correspond to a O 1s peak shift of 0.5-2 eV in the X-ray photoelectron spectroscopy (XPS) for C—$SnO_{2-x}$ compared to C—$SnO_2$ without surface oxygen vacancies, and the relative area ratio of the oxygen vacancy peak to the total O 1s peak of approximately 40%.

In some embodiments, the nanoparticles possess 0.5-2 oxygen vacancies per square nanometer (OVs $nm^{-2}$), preferably 0.7-1.8 OVs $nm^{-2}$, preferably 0.9-1.6 OVs $nm^{-2}$, preferably 1.0-1.4 OVs $nm^{-2}$, preferably 1.1-1.3 OVs $nm^{-2}$, and preferably 1.2 OVs $nm^{-2}$.

The electrode includes a fluorine-doped tin oxide substrate. The substrate may include, but is not limited to, a tin doped indium oxide (ITO) substrate, an aluminum doped zinc oxide (AZO) substrate, a niobium doped titanium dioxide (NTO) substrate, an indium doped cadmium oxide (ICO) substrate, an indium doped zinc oxide (IZO) substrate, a fluorine doped zinc oxide (FZO) substrate, a gallium doped zinc oxide (GZO) substrate, an antimony doped tin oxide (ATO) substrate, a phosphorus doped tin oxide (PTO) substrate, a zinc antimonate substrate, a zinc oxide substrate, a ruthenium oxide substrate, a rhenium oxide substrate, a silver oxide substrate, and a nickel oxide substrate. In some embodiments, elements such as Ni, Al, Cu, Fe, Ag, Zn, Sn, Sb, Ti, In, V, Cr, Co, C, Ca, Mo, Au, P, W, Rh, Mn, B, Si Ge, Se, Ln, Ga, Ir, and an alloy or a mixture of two or more of the substance, may be disposed on the surface of the substrate.

A film of the nanoparticles is present on at least one surface of the fluorine-doped tin oxide substrate. In an embodiment, the fluorine-doped tin oxide substrate is deposited partially or wholly with at least one layer of the nanoparticles in a uniform and continuous manner. In an embodiment, the nanoparticles form a monolayer on the fluorine-doped tin oxide substrate. In another embodiment, the nanoparticles may include more than a single layer on the fluorine-doped tin oxide substrate.

In some embodiments, the nanoparticles have an average diameter of 1-5 nm, preferably 1.5 to 4.9 nm, preferably 1.6 to 4.8 nm, preferably 1.7 to 4.7 nm, preferably 1.8 to 4.6 nm, preferably 1.9 to 4.5 nm, preferably 2 to 4.4 nm, preferably 2 to 4.3 nm, preferably 2 to 4.2 nm, preferably 2 to 3 nm. In some embodiments, the nanoparticles have a hydrogen peroxide detection sensitivity of 2-5 $\mu A\ \mu M^{-1}\ cm^{-2}$, 2 to 5 $\mu A\ \mu M^{-1}\ cm^{-2}$, preferably 2.5 to 4.5 $\mu A\ \mu M^{-1}\ cm^{-2}$, preferably 3 to 4 $\mu A\ \mu M^{-1}\ cm^{-2}$, preferably 3.2 to 3.8 $\mu A\ \mu M^{-1}\ cm^{-2}$, preferably 3.4 to 3.6 $\mu A\ \mu M^{-1}\ cm^{-2}$, preferably about 3.5 $\mu A\ \mu M^{-1}\ cm^{-2}$.

In some embodiments, the electrode is crystalline. In some embodiments, the electrode may be single-crystalline. In some embodiments, the electrode may be polycrystalline. In some embodiments, the electrode may be nanocrystalline. In some embodiments, the electrode may have a composite crystalline structure.

In some embodiments, a method of generating hydrogen peroxide is described. The method includes applying an electrical potential to an electrolytic cell including the electrode an anode and an electrolytic solution, to form the hydrogen peroxide. In some embodiments, the electrolytic solution includes water, a base and dissolved oxygen. In some embodiments, the water may be tap water, distilled water, bi-distilled water, deionized water, deionized distilled water, reverse osmosis water, hard water, fresh water, brine/salt water. The base selected from the group consisting of an alkaline earth metal hydroxide such as beryllium hydroxide ($Be(OH)_2$), magnesium hydroxide ($Mg(OH)_2$), strontium hydroxide ($Sr(OH)_2$), and calcium hydroxide ($Ca(OH)_2$) and an alkali metal hydroxide such as lithium hydroxide (LiOH), sodium hydroxide (NaOH), potassium hydroxide (KOH) and rubidium hydroxide (RbOH), and cesium hydroxide (CsOH). In a preferred embodiment, the base is KOH. In some embodiments, the concentration of base is 1 M.

FIG. 1A illustrates a flow chart of a method 50 of detecting hydrogen peroxide at a concentration of 1 μM to 20 μM in an alkaline solution. The aqueous solution may include water and an inorganic base. The base selected from the group consisting of an alkaline earth metal hydroxide such as $Be(OH)_2$, $Mg(OH)_2$, $Sr(OH)_2$, and $Ca(OH)_2$ and an alkali metal hydroxide such as LiOH, NaOH, KOH and RbOH, and CsOH. In some embodiments, the alkaline solution is an aqueous solution of KOH. In some embodiments, the concentration of KOH is 1 M. The order in which the method 50 is described is not intended to be construed as a limitation, and any number of the described method steps can be combined in any order to implement the method 50. Additionally, individual steps may be removed or skipped from the method 50 without departing from the spirit and scope of the present disclosure.

At step 52, the method 50 includes immersing the electrode into an electrolytic cell containing the alkaline solution. In some embodiments, the electrode is fully immersed in the alkaline solution. In some embodiments, the electrode is partially immersed, with only a defined surface area submerged. In some embodiments, the electrode is immersed in a flowing electrolyte. In some embodiments, the electrode is dipped dynamically.

At step 54, the method 50 includes applying an electrical potential to the electrolytic cell and recording a peak current. In some embodiments, the peak current density is directly proportional to the concentration of $H_2O_2$ in the alkaline solution. In some embodiments, the electrical potential is 0.4-0.9 V, 0.48 to 0.9 V, preferably 0.45 to 0.8 V, more preferably 0.6 to 0.8 V, even more preferably 0.42 to 0.8V, most preferably about 0.5 V to 0.8V vs. saturated calomel electrode (SCE).

At step 56, the method 50 includes determining a concentration of the $H_2O_2$ in the alkaline solution.

Figure 1B:
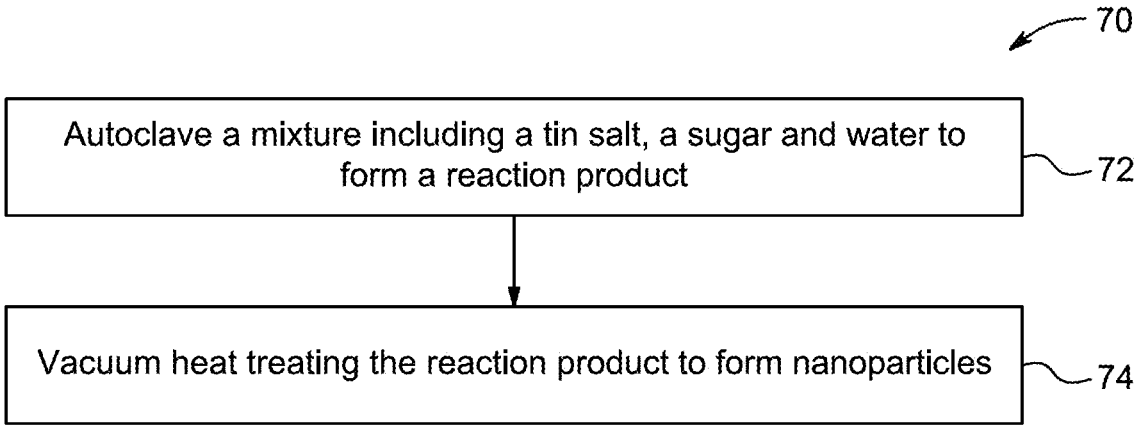
FIG. 1B is a schematic diagram of a flow chart of a method of making an electrode, according to certain embodiments.

FIG. 1B illustrates a flow chart of a method 70 of making the electrode. The order in which the method 70 is described is not intended to be construed as a limitation, and any number of the described method steps can be combined in any order to implement the method 70. Additionally, individual steps may be removed or skipped from the method 70 without departing from the spirit and scope of the present disclosure.

At step 72, the method 70 includes autoclaving a mixture including a tin salt, a sugar and water to form a reaction product. Suitable examples of tin salts include tin (II) chloride, tin (II) sulfate, tin (II) acetate, tin (IV) oxide, tin (IV) fluoride, tin (II) bromide, tin (II) hydroxide, tin (IV) chloride, tin (IV) nitrate, tin (II) carbonate, tin (II) iodide, tin (IV) sulfide, tin (II) phosphonate, tin (IV) acetate, tin (II) oxalate, tin (II) selenite, tin (II) thiocyanate, tin (IV) benzoate, tin (IV) chlorate, and tin (II) tartrate. In a preferred embodiment, the tin salt is tin chloride. In some embodiments, the concentration of the tin salt is 10-30 mM, preferably 12 to 28 mM, more preferably 14 to 26 mM, even more preferably 16 to 24 mM, most preferably 18 to 22 mM, and particularly preferably about 20 mM. In some embodiments, the sugar is glucose, fructose, galactose, sucrose, lactose, maltose. In some embodiments, the sugar is sucrose. In some embodiments, the concentration of the sugar is 0-4 M, preferably 0-3.9 M, preferably 0-3.8 M, preferably 0-3.7 M, preferably 0-3.6 M. In some embodiments, the autoclaving is at a temperature of 80-100° C., preferably 81 to 99° C., preferably 82 to 98° C., even more preferably 86 to 97° C., most preferably 88 to 96.5° C., and particularly preferably about 90° C.

At step 74, the method 70 includes vacuum heat treating the reaction product to form the nanoparticles. In some embodiments, the vacuum heat treating is at a temperature of 300-400° C., preferably 310 to 390° C., more preferably 320 to 380° C., even more preferably 330 to 370° C., most preferably 340 to 360° C., and particularly preferably about 350° C. for 2-5 hours, preferably 3 hours. In some embodiments, the heating can be done by oven heating, infrared heating, freeze heating, hot plate heating, air heating, microwave heating, spray heating, rotary evaporation, desiccator heating.

At step 76, the method 70 includes coating a surface of a fluorine-doped tin oxide substrate with the nanoparticles. In some embodiments, the nanoparticles may be coated on the surface of the fluorine-doped tin oxide substrate by physical vapor deposition (PVD), chemical vapor deposition (CVD), spin coating, dip coating, electrophoretic deposition (EPD), langmuir-blodgett (LB) technique, drop casting, sol-gel process, layer-by-layer (LbL) assembly, inkjet printing, spray coating, and ultrasonic spray deposition.

EXAMPLES

The following examples demonstrate an electrode. The examples are provided solely for illustration and are not to be construed as limitations of the present disclosure, as many variations thereof are possible without departing from the spirit and scope of the present disclosure.

Example 1: Method

Carbon-doped $SnO_2$ nanoparticles were synthesized via a two-step, low-temperature (95° C.) hydrothermal process followed by heat treatment under vacuum. The approach is a cost-effective and eco-friendly process, as the reaction occurs in an aqueous solution without the need for surfactants, hazardous reagents, or organic solvents. All chemicals are analytical-grade reagents and are utilized as received without additional purification. In a standard synthesis, 20 mM $SnCl_2$ was combined with varying amounts of $C_{12}H_{22}O_{11}$ (ranging from 0 to 3.6 M) and dissolved in water. A 100 mL Teflon-lined stainless-steel autoclave was filled with the acquired solution, sealed, and held at 95° C. for varying durations (2 to 6 hours). To enhance surface oxygen vacancy in C—$SnO_2$, the C—$SnO_2$ films were placed in a porcelain combustion boat at 350° C. for 2 hours under vacuum to yield surface oxygen vacancies nanoparticles (SOV NP)C—$SnO_{2-x}$/FTO. X-ray photoelectron spectroscopy (XPS) was used to confirm and quantify the presence and relative concentration of surface oxygen vacancies in C—$SnO_{2-x}$ nanoparticles. The O 1s spectra showed both the lattice oxygen signal and a prominent component corresponding to oxygen vacancies. The relative area ratio of the oxygen vacancy peak to the total O 1s peak of approximately 40%, which indicates the SOV-NP C—$SnO_{2-x}$ nanoparticles possess a surface oxygen vacancy (SOV) density of 1.2 vacancies per square nanometer (1.2 OVs/$nm^2$).

Figure 2:
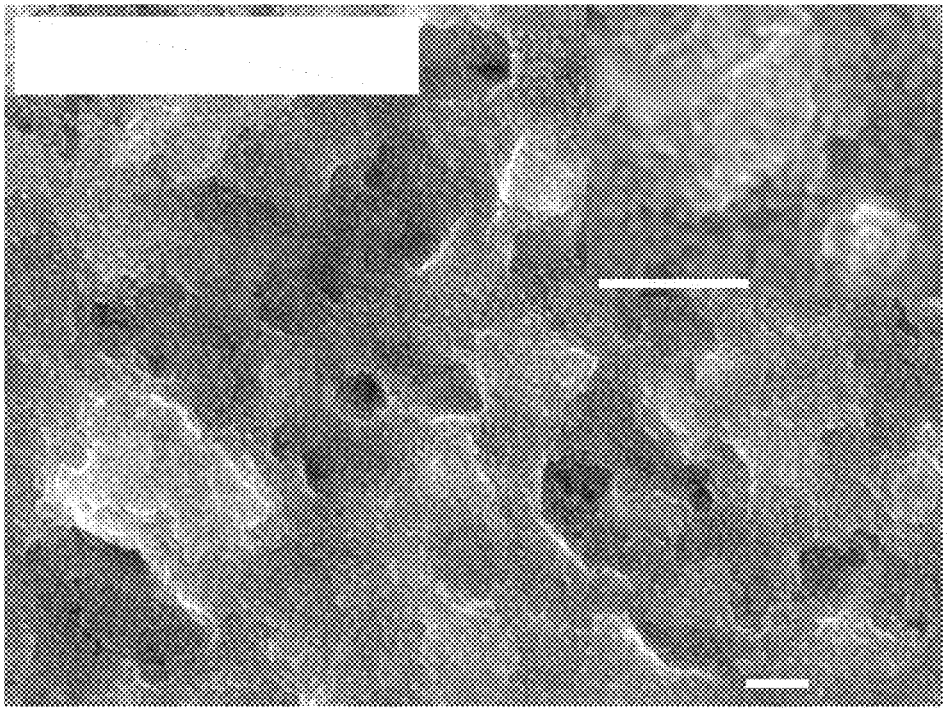
FIG. 2 shows field emission scanning electron microscopy (FESEM) at various magnifications of the surface morphology of an SOV-NP C—$SnO_{2-x}$, according to certain embodiments. The scale bars denote 100 nm.

FIG. 2 shows a field emission scanning electron microscopy (FESEM) at various magnifications of the surface morphology of an SOV-NP C—$SnO_{2-x}$, which was used for comparative analysis in the electrochemical production and detection of hydrogen peroxide using an SOV-NP C—$SnO_{2-x}$ catalyst according to the present disclosure. The surface of the SOV-NP C—$SnO_{2-x}$ has a textured and pitted morphology. The SOV-NP C—$SnO_{2-x}$ nanoparticles have a primarily spherical shape, with an average particle size of roughly 3 nm and a broad size distribution, according to the FESEM images in FIG. 2. Higher magnifications reveal a layered surface texture of the nanoparticles. Improved catalytic activity is made possible by this layered morphology, which also increases surface area. There is no discernible aggregation and the particles are evenly distributed, which further suggests a clearly defined nanostructure. The SOV-NP C—$SnO_{2-x}$ nanoparticles are distinguished by their spherical shape, broad size distribution, nanoscale dimensions, and layered surface features, which also improve their performance in electrochemical hydrogen peroxide production and detection.

Figure 3:
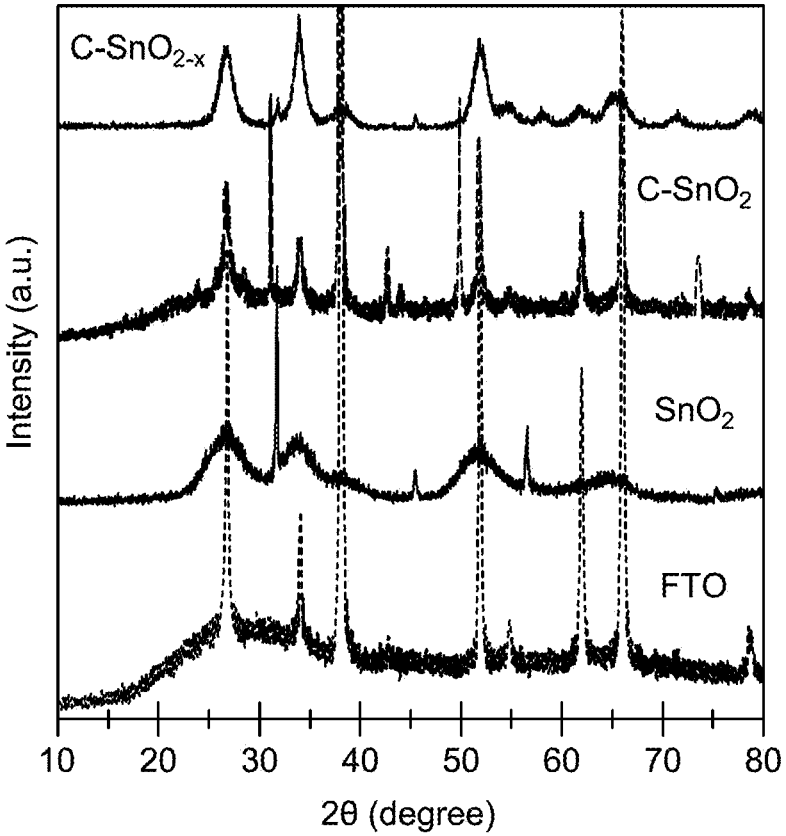
FIG. 3 shows X-ray powder diffraction (XRD) analysis of fluorine-doped tin oxide supported electrode, tin oxide ($SnO_2$) electrode, carbon-doped tin oxide electrode (C—$SnO_2$), and a carbon-doped tin oxide electrode with surface oxygen vacancies (SOV NP C—$SnO_{2-x}$) in a 1.0 M potassium hydroxide (KOH) solution at a scan rate 20 mV/s, according to certain embodiments.

FIG. 3 shows the X-ray powder diffraction (XRD) analysis for all prepared electrodes in comparison with the support: (i) fluorine-doped tin oxide (FTO) supported electrode, (ii) tin oxide ($SnO_2$) electrode, (iii) carbon-doped tin oxide electrode (C—$SnO_2$), and (iv) a carbon-doped tin oxide electrode with surface oxygen vacancies (SOV NP C—$SnO_{2-x}$) in a 1.0 M KOH solution at a scan rate 20 m V/s.

FIG. 3A shows X-ray photoelectron spectroscopy (XPS) survey spectra for $SnO_2$, C—$SnO_2$, and SOV-NP C—$SnO_{2-x}$ electrodes. FIGS. 3B-3D show high-resolution XPS spectra for the O 1s, Sn 2p, and C 1s regions of the SOV-NP C—$SnO_{2-x}$ electrode, respectively.

Figure 4A:
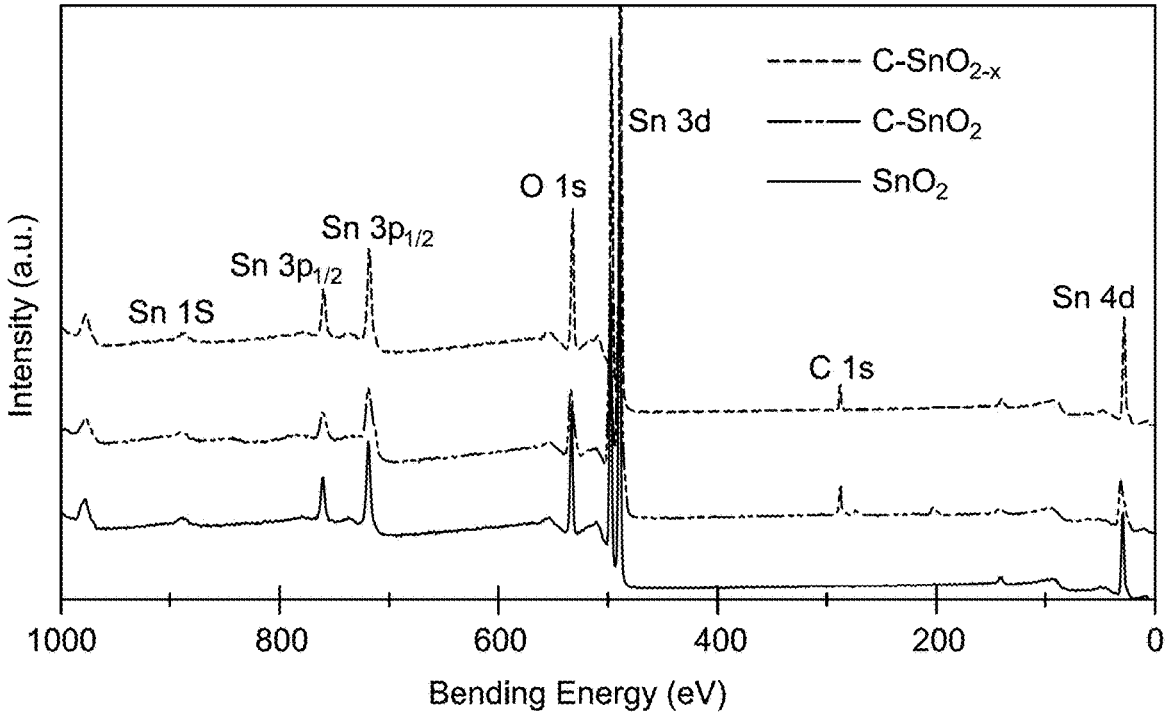
FIG. 4A shows X-ray photoelectron spectroscopy (XPS) survey spectra for the $SnO_2$, C—$SnO_2$, and SOV-NP C—$SnO_{2-x}$ electrodes, according to certain embodiments.
Figure 4B:
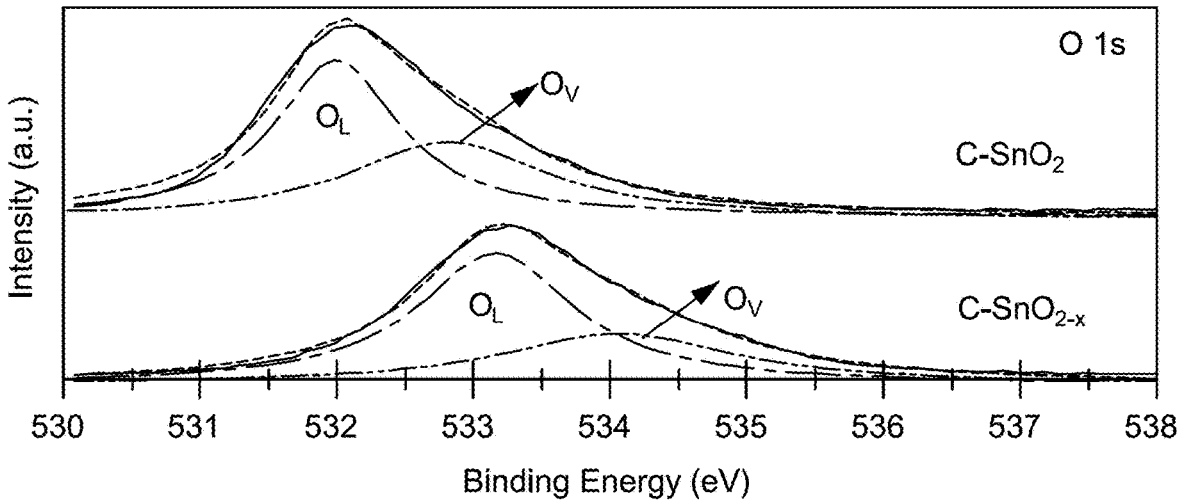
FIG. 4B shows high-resolution XPS spectra for O 1s region of the SOV-NP C—$SnO_{2-x}$ electrode, according to certain embodiments.
Figure 4C:
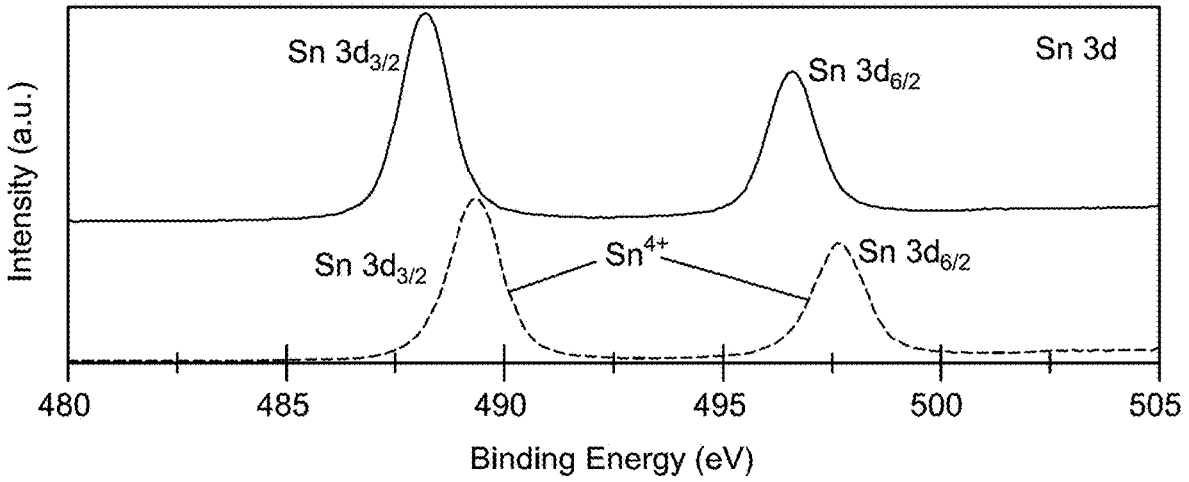
FIG. 4C shows high-resolution XPS spectra for Sn 2p region of the SOV-NP C—$SnO_{2-x}$ electrode, according to certain embodiments.
Figure 4D:
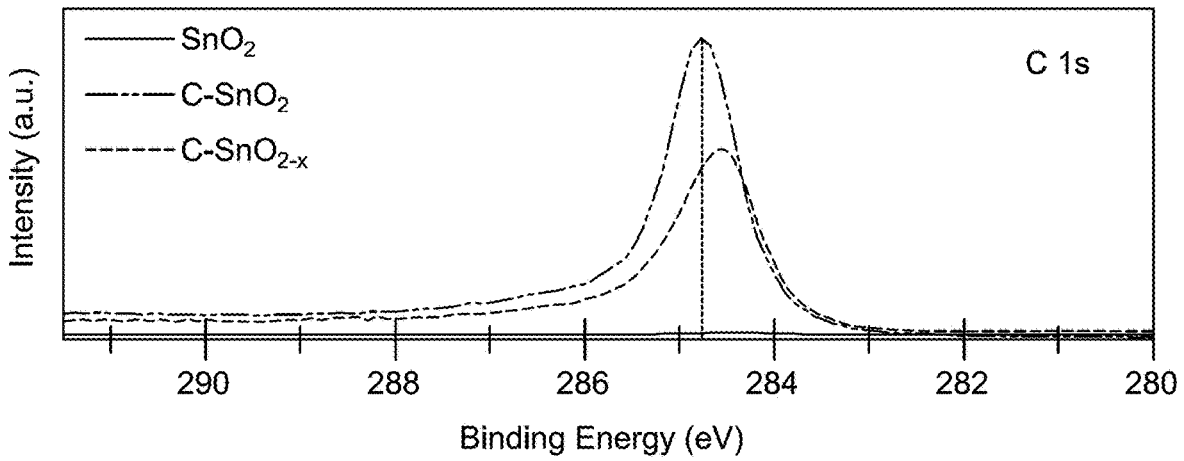
FIG. 4D shows high-resolution XPS spectra for C 1s region of the SOV-NP C—$SnO_{2-x}$ electrode, according to certain embodiments.
Figure 5A:
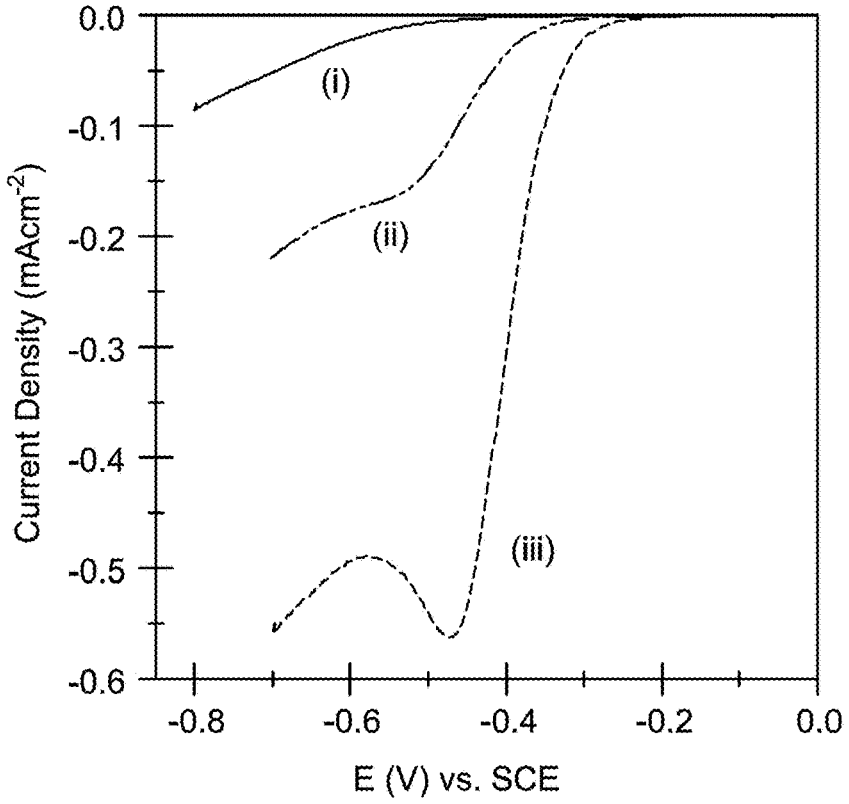
FIG. 5A shows a linear sweep voltammogram (LSV) comparing the $SnO_2$, NP C—$SnO_2$, and SOV NP C—$SnO_{2-x}$ electrodes in a 1.0 M KOH solution at 20 mV/s, according to certain embodiments.
Figure 5B:
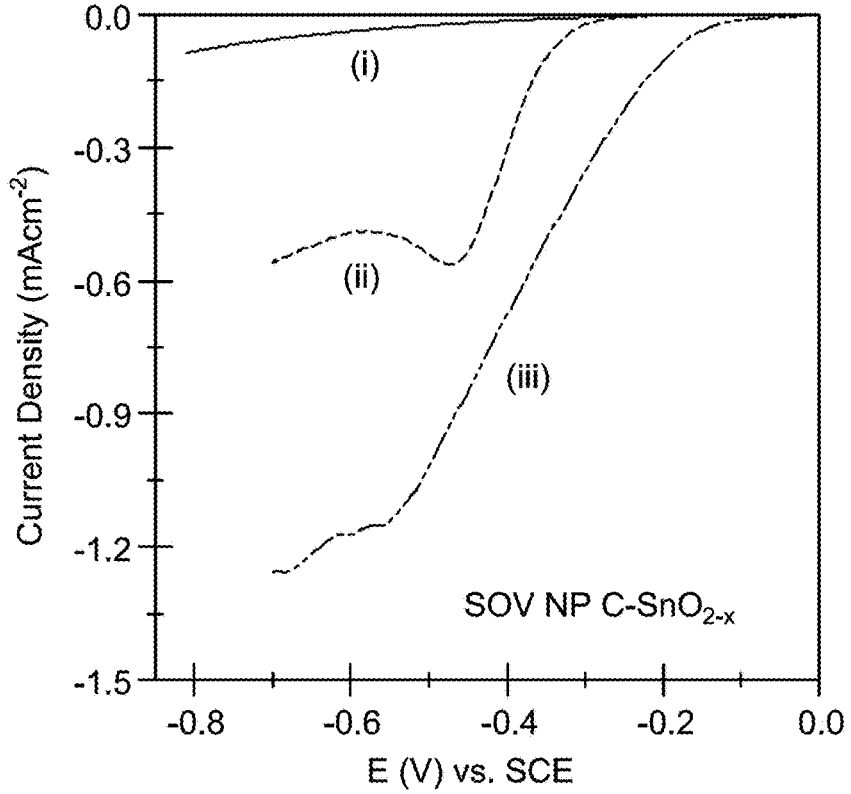
FIG. 5B shows LSV for the SOV NP C—$SnO_{2-x}$ electrode in a 1.0 M KOH solution at 20 mV/s, purged for 30 minutes with pure nitrogen, air, and pure oxygen, according to certain embodiments.
Figure 6A:
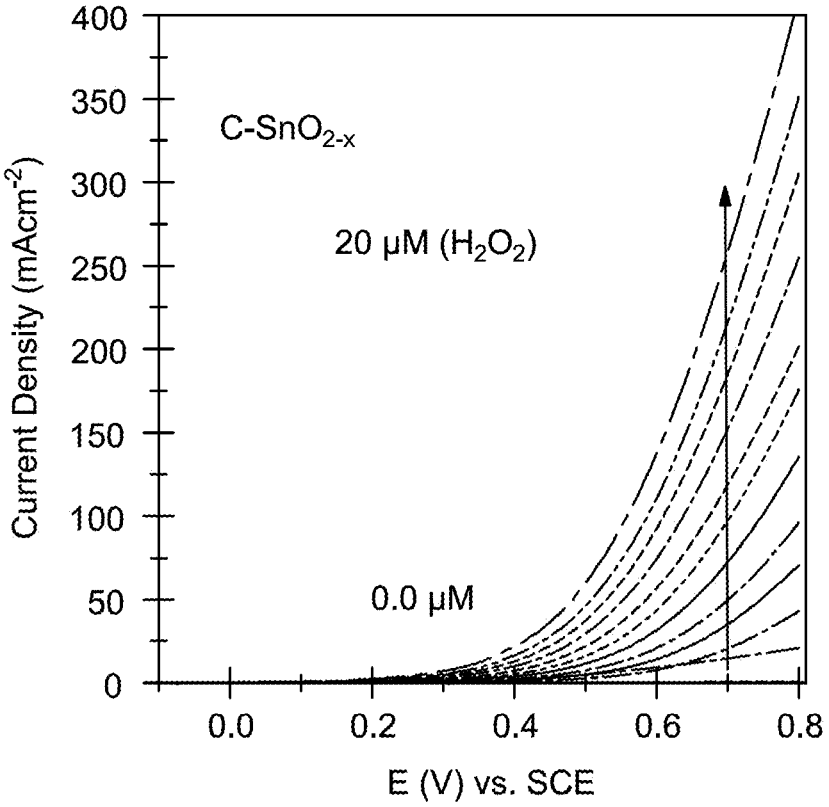
FIG. 6A shows a composite LSV carried out in 1.0 M KOH, with LSV traces obtained from the consecutive addition of M aliquots of $H_2O_2$ to the solution, according to certain embodiments.
Figure 6B:
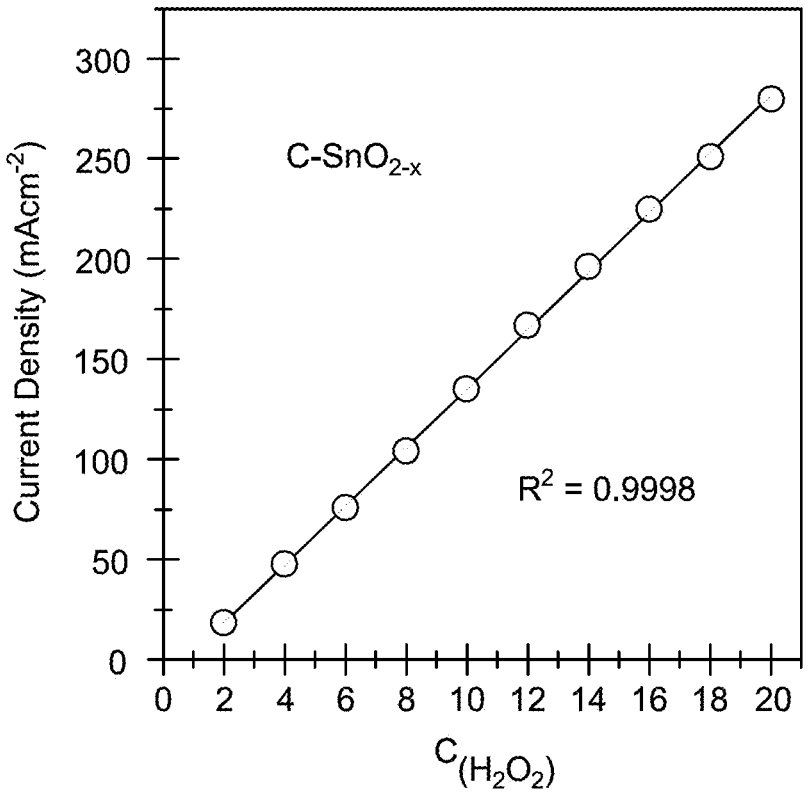
FIG. 6B shows a plot of peak current vs. $H_2O_2$ concentration based on the traces, according to certain embodiments.

FIG. 4A shows a linear sweep voltammogram (LSV) comparing (i) a $SnO_2$ electrode, (ii) a NP C—$SnO_2$ electrode, (iii) a SOV NP C—$SnO_{2-x}$ electrode in a 1.0 M KOH solution at 20 mV/s. FIG. 4B shows a graph depicting LSV for the SOV NP C—$SnO_{2-x}$ electrode in a 1.0 M KOH solution at 20 mV/s, purged for 30 minutes with (i) pure nitrogen, (ii) air, and (iii) pure oxygen. FIG. 5A shows a composite LSV carried out in 1.0 M KOH, with LSV traces obtained from the consecutive addition of M aliquots of $H_2O_2$ to the solution. FIG. 5B shows a plot of peak current vs. $H_2O_2$ concentration based on the traces.

In the present disclosure, the method for the electrochemical production and detection of hydrogen peroxide using tin oxide nanoparticle catalysts, modified with carbon as a dopant and surface oxygen vacancies (SOV-NP C—$SnO_{2-x}$) is described. The SOV-NP C—$SnO_{2-x}$ electrode functions as a cathode for $H_2O_2$ generation and is immersed with an anode in a 1 M KOH solution saturated with oxygen inside the electrolytic cell. The SOV-NP C—$SnO_{2-x}$ electrode works as the anode for $H_2O_2$ detection when combined with a cathode in a 1 M KOH solution in the electrolytic cell. the tin oxide is doped with carbon.

The SOV-NP C—$SnO_{2-x}$ films were utilized, for the first time, as functional electrodes in high-performance generation and detection with elevated sensitivity concurrently. The SOV-NP C—$SnO_{2-x}$/FTO thin films exhibited exceptional sensitivity for hydrogen peroxide detection in alkaline environments, with a high detection sensitivity of around 3.5 $\mu A\ \mu M^{-1}\ cm^{-2}$ across a broad range of hydrogen peroxide concentrations from approximately 1.0 μM to 20 μM, with a working potential range of approximately 0.5-0.8 V vs SCE. The findings demonstrate that SOV-NP C—$SnO_{2-x}$ provides a substantial number of active reaction sites, hence improving electrocatalytic activity and electrochemical sensitivity. It is hypothesised that synergistic interactions between C-doping and SOV enhance both $H_2O_2$ production and sensing capabilities. Consequently, the present disclosure presents prospects for the development of materials exhibiting remarkable electrochemical properties. The present disclosure presents a high-efficiency bifunctional electrocatalyst for chemical synthesis and detection.

Numerous modifications and variations of the present disclosure are possible in light of the above teachings. It is therefore to be understood that within the scope of the appended claims, the invention may be practiced otherwise than as specifically described herein.

The invention claimed is:

1. A method of generating hydrogen peroxide, comprising:

applying an electrical potential to an electrolytic cell comprising an electrode, an anode and an electrolytic solution, to form the hydrogen peroxide;

wherein the electrode comprises:

nanoparticles of a carbon-doped tin oxide of formula C—$SnO_{2-x}$ wherein x=is from 0.001 to 0.1, having surface oxygen vacancies, a fluorine-doped tin oxide substrate, wherein a film of the nanoparticles is present on at least one surface of the fluorine-doped tin oxide substrate, wherein the surface oxygen vacancies correspond to a O 1s peak shift of 0.5-2 eV in the X-ray photoelectron spectroscopy (XPS) for C—$SnO_{2-x}$ compared to C—$SnO_2$ without surface oxygen vacancies.

2. The method of claim 1, wherein the nanoparticles of the electrode have a surface oxygen vacancy density of 0.5-2 oxygen vacancies per square nanometer (Ovs $nm^{-2}$).

3. The method of claim 1, wherein the nanoparticles of the electrode have a textured and pitted surface morphology.

4. The method of claim 1, wherein the nanoparticles of the electrode have an average diameter of 1-5 nm.

5. The method of claim 1, wherein the electrode has a hydrogen peroxide detection sensitivity of 2-5 $\mu A\ \mu M^{-1}\ cm^{-2}$.

6. The method of claim 1, the electrolytic solution comprising water, a base and dissolved oxygen.

7. The method of claim 6, wherein the base is KOH.

8. The method of claim 6, wherein the concentration of base is 1 M.

* * * * *